US010485275B2

(12) United States Patent
Nhim

(10) Patent No.: US 10,485,275 B2
(45) **Date of Patent: *Nov. 26, 2019**

(54) HALTER BIB ATHLETIC GARMENT

(71) Applicant: Bell Sports, Inc., Scotts Valley, CA (US)

(72) Inventor: Karany Nhim, San Francisco, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/134,406

(22) Filed: Sep. 18, 2018

(65) Prior Publication Data

US 2019/0014833 A1 Jan. 17, 2019

Related U.S. Application Data

(63) Continuation of application No. 14/939,753, filed on Nov. 12, 2015, now Pat. No. 10,076,141.

(60) Provisional application No. 62/078,509, filed on Nov. 12, 2014.

(51) Int. Cl.

| | |
|---|---|
| ***A41D 13/00*** | (2006.01) |
| ***A41D 27/20*** | (2006.01) |
| ***A41D 31/00*** | (2019.01) |
| ***A41D 1/08*** | (2018.01) |
| ***A41F 19/00*** | (2006.01) |

(52) U.S. Cl.

CPC ..... *A41D 13/0017* (2013.01); *A41D 1/08* (2013.01); *A41D 27/20* (2013.01); *A41D 31/00* (2013.01); *A41F 19/00* (2013.01); *A41D 2400/70* (2013.01); *A41D 2600/104* (2013.01)

(58) Field of Classification Search

CPC ..... A41D 1/08; A41D 31/00; A41D 2400/70; A41D 2600/104; A41F 19/00

USPC ..... 2/69

See application file for complete search history.

(56) References Cited

U.S. PATENT DOCUMENTS

| | | | |
|---|---|---|---|
| 1,867,445 | A | 7/1932 | Dills |
| 2,042,924 | A | 6/1936 | Cunningham |
| 3,263,685 | A | 8/1966 | Bernfeld |
| 4,805,243 | A | 2/1989 | Gibbens et al. |
| 5,642,526 | A | 7/1997 | Thompson |

(Continued)

FOREIGN PATENT DOCUMENTS

| | | |
|---|---|---|
| CA | 2933275 | 6/2015 |
| RU | 2011149775 | 4/2014 |

*Primary Examiner* — Anne M Kozak

(74) *Attorney, Agent, or Firm* — Booth Udall Fuller, PLC

(57) ABSTRACT

A halter bib athletic garment is described herein. A halter bib athletic garment may be removed or lowered without removing a jersey by simply pulling a halter strap over the head of a wearer. One or more embodiments of a halter bib allow wearers to more readily urinate or have a bowel movement because the halter bib may be easily lowered or removed. A halter bib athletic garment may include a lower body section, a chamois coupled to the lower body section, and an upper body section. The upper body section comprises a halter strap forming a portion of a loop of a head opening on the upper body section. The halter strap includes two front side portions and a rear side portion positioned between the front side portions. The rear side portion is coupled to the athletic garment only with the front side portions of the halter strap.

16 Claims, 10 Drawing Sheets

(56) References Cited

U.S. PATENT DOCUMENTS

| | | | | |
|---|---|---|---|---|
| 5,790,984 | A * | 8/1998 | Doubleday | A41B 9/005 2/227 |
| 6,460,186 | B1 | 10/2002 | Dailly | |
| D515,284 | S * | 2/2006 | Africa | D2/714 |
| 7,707,659 | B2 * | 5/2010 | Africa | A41D 1/084 2/267 |
| 7,945,970 | B2 | 5/2011 | Belluye et al. | |
| 8,230,520 | B2 * | 7/2012 | Riondato | A41D 1/084 2/275 |
| D725,348 | S | 3/2015 | Cutler | |
| D725,349 | S * | 3/2015 | Cutler | D2/731 |
| D746,023 | S * | 12/2015 | Maier | D2/731 |
| D768,959 | S * | 10/2016 | Maier | D2/731 |
| 2003/0056282 | A1 * | 3/2003 | Coccia | A41D 1/084 2/466 |
| 2005/0066423 | A1 | 3/2005 | Hogan | |
| 2005/0223478 | A1 * | 10/2005 | Hogan | A41D 1/084 2/466 |
| 2006/0277645 | A1 | 12/2006 | Okajima | |
| 2007/0226869 | A1 * | 10/2007 | Maier | A41D 1/084 2/69 |
| 2009/0113598 | A1 * | 5/2009 | Maier | A41D 1/084 2/79 |
| 2010/0180361 | A1 | 7/2010 | Marois et al. | |
| 2012/0266361 | A1 * | 10/2012 | Maier | A41B 9/023 2/227 |
| 2016/0316825 | A1 * | 11/2016 | Cutler | A41D 1/084 |

* cited by examiner

HALTER BIB ATHLETIC GARMENT

CROSS REFERENCE TO RELATED APPLICATIONS

This document is a continuation of U.S. patent application Ser. No. 14/939,753 filed Nov. 12, 2015, entitled "HALTER BIB ATHLETIC GARMENT" to Nhim, which claims the benefit of the filing date of U.S. Provisional Patent Application 62/078,509, entitled "ATHLETIC HALTER BIB" to Nhim, which was filed on Nov. 12, 2014, the contents of both of which are hereby incorporated by this reference.

BACKGROUND

1. Technical Field

Aspects of this document relate generally to athletic garments for cyclists.

2. Background Art

Athletic garments assist people in enjoying and competing in numerous sports. One type of garment worn is a bib garment designed with suspender-style supporting members. A benefit of a bib garment is that the garment is supported from the shoulders rather than by a waistband gripping the wearer's waist. Athletic bib garments are commonly used for cycling because they eliminate the discomfort and chafing caused by waistbands and retain the placement of the padded "chamois" under a cyclists sit bones better than cycling shorts. Unfortunately, cycling bibs are notoriously difficult in accommodating cyclists who need to urinate or pass a bowel movement. Currently, cyclists must remove their jersey, remove the suspender-style supporting members of the traditional cycling bib, and only then can lower the remainder of the bib to relieve themselves. This problem is exacerbated by the fact that cycling bibs are intended to be worn without bottom underwear, and a chamois can gather bacteria and contaminants if not kept clean. Worse yet, female cyclists must confront this dilemma with fewer options than male cyclists. Male cyclists can purchase bibs with a zippered or non-zippered access fly. Some bib garments exist that include a "drop trunk" that allows the back side of the garment trunk to be lowered below the wearer's buttocks but still remain attached in the front, but such are not always convenient for use when needed either.

SUMMARY

According to one aspect, an athletic garment comprises a lower body section, a chamois, and an upper body section. The lower body section comprises a front side, a rear side, two leg openings, and a pelvic section. The chamois is coupled to the lower body section at a base of the pelvic section. The upper body section is coupled to the lower body section proximate the pelvic section and comprises a halter strap forming at least a portion of a loop of a head opening on the upper body section. The halter strap comprises two front side portions and a rear side portion positioned between the two front side portions. The rear side portion is coupled to the athletic garment only with the front side portions of the halter strap.

Various implementations and embodiments may comprise one or more of the following. The upper body section may comprise a bodice section between the halter strap and the pelvic section. The bodice section may comprise a front side proximate a front side of the lower body section and a rear side proximate a rear side of the lower section, and wherein the athletic garment is devoid of any material extending between the rear side portion of the halter strap and the rear side of the bodice section. A pocket on the rear side of the bodice, the pocket comprising a pocket opening in an outer layer of the rear side of the bodice, a flap on an outer surface of the outer layer and configured to cover the pocket opening, and a mesh layer coupled to an inner surface of the outer layer of the rear side of the bodice. The front side of the bodice section may comprise a mesh material. The halter strap may comprise an elastomeric fabric and two opposing terminating ends each coupled to a different peak of two peaks on the front side of the bodice such that the single loop is bordered by the bodice and the halter strap. The halter strap may comprise a folded halter strap comprising an inner edge comprising a fold in the folder halter strap and an outer edge comprising two side edges of the halter strap coupled together.

According to another aspect, an athletic garment comprises a lower body section, a chamois, and an upper body section. The lower body section comprising a front side, a rear side, two leg openings, and a pelvic section. The chamois is coupled to the lower body section at a base of the pelvic section. The upper body section is coupled to the lower body section proximate the pelvic section, and the upper body section compriese a back opening and a halter strap forming at least a portion of loop of a head opening on the upper body section. The halter strap comprises two front side portions and a rear side portion. The back opening extends from the rear side portion of the halter strap to at least one-third of a distance between the rear side portion of the halter strap and the rear side of the lower body section, the back opening being devoid of any material extending across the back opening.

Various implementations and embodiments may include one or more of the following. The upper body section may comprise a bodice section between the halter strap and the lower body section, and the bodice section may comprise a front side and a rear side. The back opening may extend from the rear side portion of the halter strap to the back side portion of the bodice and may be devoid of material connecting the rear side portion of the halter strap to the rear side of the bodice. A pocket on the rear side of the bodice, the pocket comprising a pocket opening in an outer layer of the rear side of the bodice, a flap on an outer surface of the outer layer and configured to cover the pocket opening, and a mesh layer coupled to an inner surface of the outer layer of the rear side of the bodice. The front side of the bodice section may comprise a mesh material. The halter strap may comprise an elastomeric fabric and two opposing terminating ends each coupled to a different peak of two peaks on the front side of the bodice such that the single loop is bordered by the bodice and the halter strap. The halter strap may comprise a folded halter strap comprising an inner edge comprising a fold in the folder halter strap and an outer edge comprising two side edges of the halter strap coupled together.

According to another aspect, an athletic garment comprises an upper body section, a lower body section, and a chamois coupled to the lower body section. The upper body section comprises only two body openings, the two body openings comprising a head opening sized to receive a head of a wearer and fit around a neck of the wearer, and a back opening sized to receive a torso of the wearer. The lower body section is adjacent the upper body section and comprises two leg openings distal the upper body section.

Various implementations and embodiments may comprise one or more of the following. The lower body section may comprise a front side, a rear side, and a pelvic section, the chamois being coupled the lower body section at a base of the pelvic section, and wherein the an upper body section is coupled to the lower body section proximate the pelvic section and comprises a halter strap that forms a portion of the head opening on the upper body section, the halter strap comprising two front side portions and a rear side portion, wherein the back opening extends from the rear side portion of the halter strap to at least one-third of a distance between the rear side portion of the halter strap and the rear side of the lower body section, the back opening being devoid of any material. The upper body section may comprise a bodice section between the halter strap and the lower body section, the bodice section comprising a front side and a rear side, wherein the back opening extends from the rear side portion of the halter strap to the back side portion of the bodice and is devoid of material connecting the rear side portion of the halter strap to the rear side of the bodice. A pocket on the rear side of the bodice, the pocket comprising a pocket opening in an outer layer of the rear side of the bodice, a flap on an outer surface of the outer layer and configured to cover the pocket opening, and a mesh layer coupled to an inner surface of the outer layer of the rear side of the bodice. The front side of the bodice section may comprise a mesh material. The halter strip may comprise an elastomeric fabric and two opposing terminating ends each coupled to a different peak of two peaks on the front side of the bodice such that the head opening is bordered by the bodice and the halter strap. The halter strap may comprise a folded halter strap comprising an inner edge comprising a fold in the folder halter strap and an outer edge comprising two side edges of the halter strap coupled together.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

Figure 1:
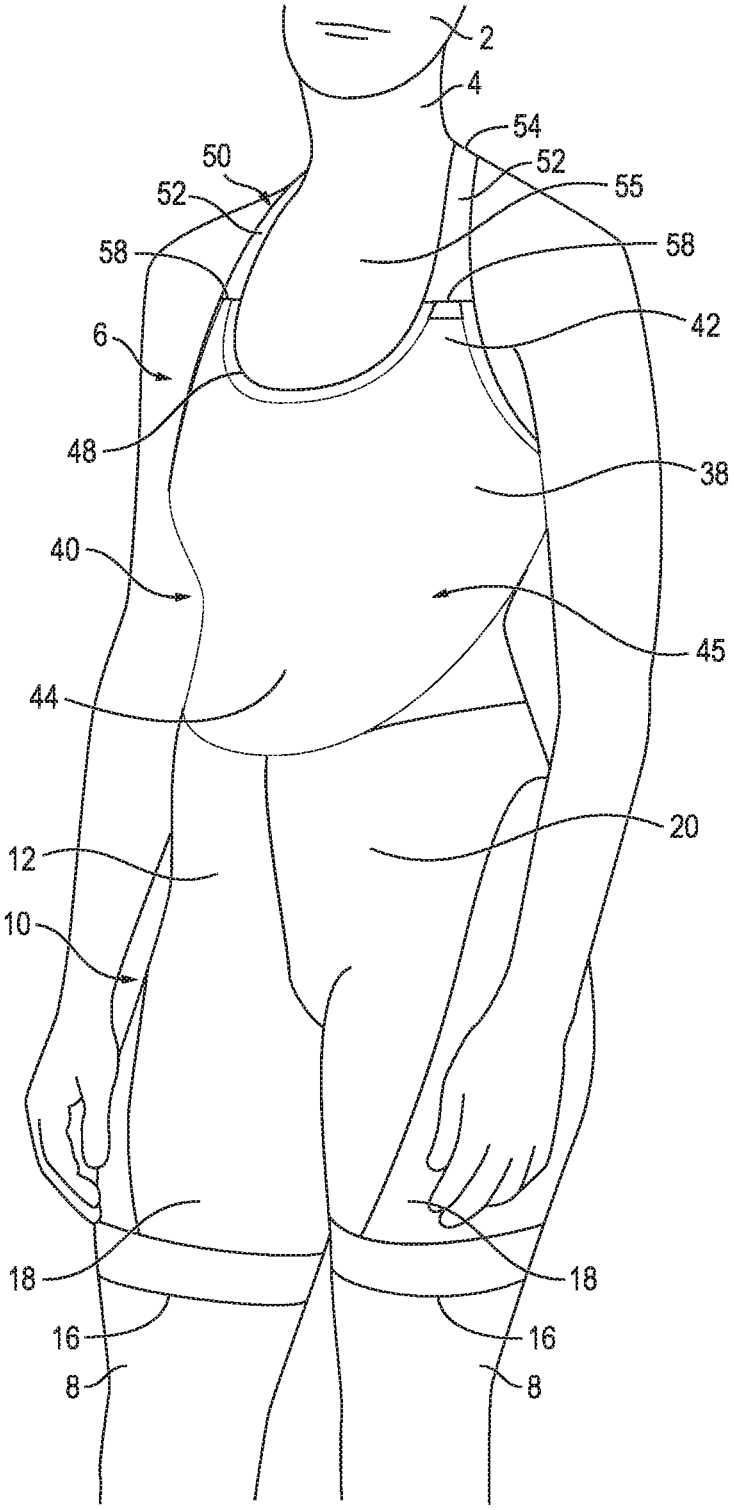
FIG. 1 is a perspective view of a halter bib athletic garment being worn by a wearer.

In the following description, and for the purposes of explanation, numerous specific details are set forth in order to provide a thorough understanding of the various aspects of the invention. It will be understood, however, by those skilled in the relevant arts, that the present disclosed embodiments and methods may be practiced without these specific details. In other instances, known structures and devices are shown or discussed more generally in order to avoid obscuring the disclosure. In many cases, a description of the operation is sufficient to enable one to implement the various forms of the garments and methods. It should be noted that there are many different and alternative configurations, devices and technologies to which this disclosure may be applied. The full scope of the disclosure is not intended to be limited by the specific examples that are described below.

As described in the above, conventional bib garments have various limitations. Cyclists and other athletes, particularly women, would benefit from an easier solution to removing cycling bibs while wearing a jersey or jacket. As shall be shown in the various embodiments described or otherwise contemplated as part of this disclosure, the halter bib garment may be removed or lowered without removing a jersey by simply pulling a halter strap over the head of a wearer. One or more embodiments of a halter bib allow wearers to more readily urinate or have a bowel movement because the halter bib may be easily lowered or removed. For example, a cyclist wearing a halter bib can quickly stop cycling and urinate without the hassle and exposure of removing a jersey. Female cyclists benefit greatly from the halter bib because their anatomy provides fewer options for quickly and easily urinating or passing a bowel movement than the options enjoyed by male cyclists (some male cycling bibs and shorts have a zippered or non-zippered fly). For example, a female cyclist wearing a halter bib can lower the halter bib to urinate such that the chamois is out of the way and not contaminated by streaming or stray urine.

FIGS. 1-9 illustrate various specific embodiments and aspects of a halter bib athletic garment with a halter loop fitting around the neck of a wearer. These specific embodiments and aspects will be described more generally here. A halter bib athletic garment may be worn by both genders for cycling (e.g., road cycling, mountain biking, stationary bikes, and other cycling activities) or racing and training for triathlons or other races incorporating cycling. Alternatively, the halter bib may be worn during other athletic activities in addition to cycling, such as, running, snow skiing, and so forth. The halter bib may be a short-length halter bib (extending to the thigh), a full-length halter bib (extending to the calf or ankle), or a mid-lenght halter bib (with a length between the short-length and long-length halter bibs. The mid-length or long-length halter bibs are specifically contemplated for potential use as a thermal base layer in cold weather sports. The halter bib is generally form-fitting and provides reduced drag in air and water, but can also have some portions that are not form-fitting (e.g., to provide a "baggy shorts" look). The fabric, cut, and design of the halter bib may reduce air resistance and/or help regulate body temperature (e.g., using a material to wick away sweat). In some embodiments, the halter bib is constructed substantially from stretchy or elastomeric synthetic fibers and fabrics, such as, spandex, Lycra®, nylon, polyester, acrylic, elastine, Roubaix®, Zaffiro Topazio knits of synthetic and natural fibers, knits of multiple types of synthetic fibers, and similar fabrics. In one particular embodiment, the fabric used comprises a material that uses 15%-30% Elastane. A halter bib may also be constructed of fabrics of varying weights intended for cold or warm weather applications.

In one or more embodiments, an athletic garment 1 comprises an upper body section 40 and a lower body section 10. An upper body section 40 may comprise a halter strap 50 forming at least a portion of a loop 48 of a head opening 55 on the upper body section 40. According to some aspects, a halter strap 50 may comprise two front side portions 52 and a rear side portion 54 positioned between the two front side portions 52. Although the various portions may be sewn together, the front side portions 52 and the rear side portion 54 comprise a continuous, uninterrupted halter strap 50, meaning that there is no tie, zipper, snap or other temporary coupling to separate the strap. Generally, the rear side portion 54 is positioned on the halter bib athletic garment 1 to cover or pass around the back of the neck 4 of the wearer, while the two front side portions 52 are positioned on the halter bib athletic garment 1 cover or pass over a portion of the side of the neck 4 of the wearer. In any event, the rear side portion 54 comprises a portion of the halter strap positioned between the two front side portions 52 of the halter strap 50. In such embodiments, the rear side portion 54 may be coupled to the athletic garment with only the front side portions 52 of the halter strap 50. Such a configuration is in contrast to conventional athletic or cycling garments, which include one or more straps or other material extending down the back of the wearer to couple the strap to other portions of the garment (such as the rear side of the lower body section).

Figure 4:
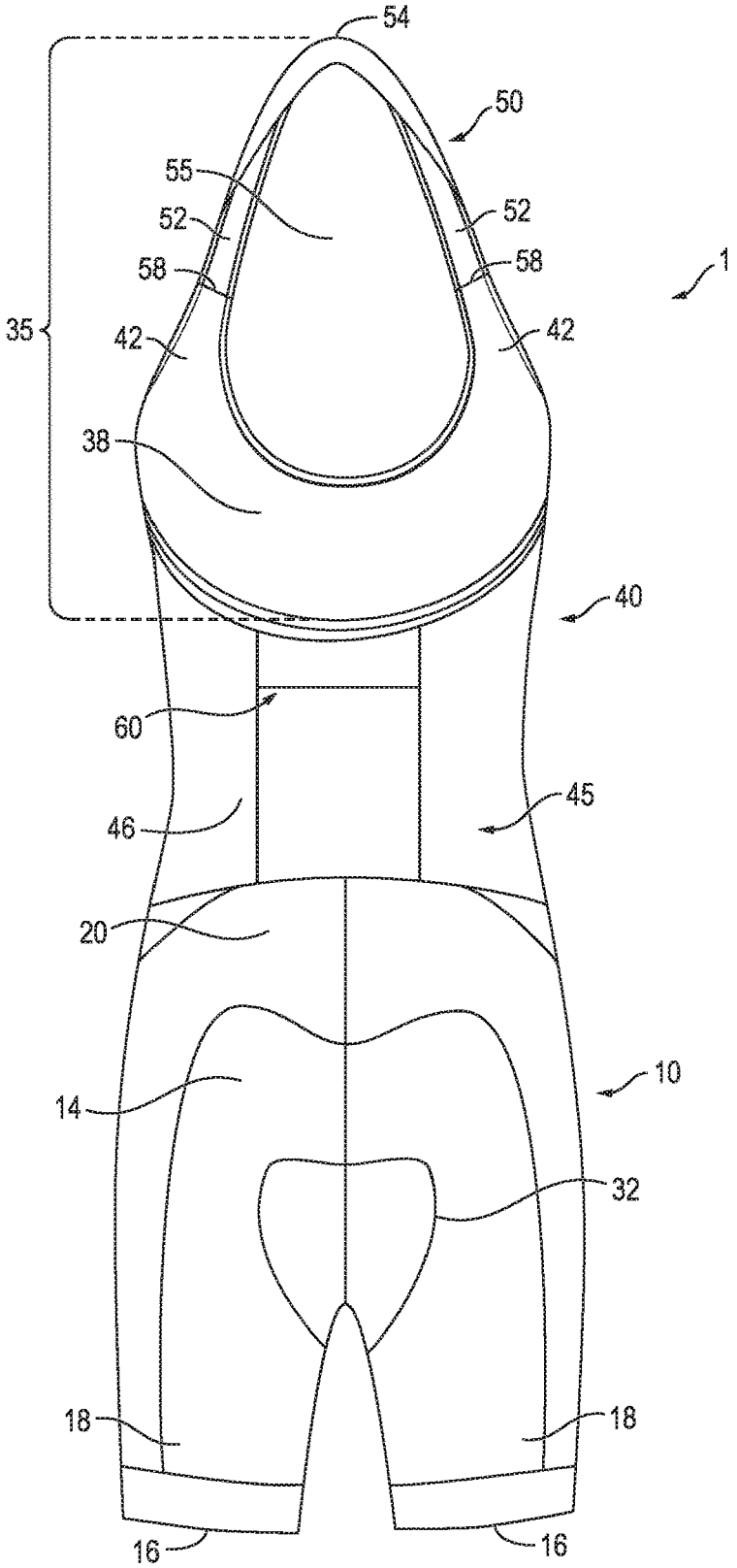
FIG. 4 is a rear view of a halter bib athletic garment.
Figure 5:
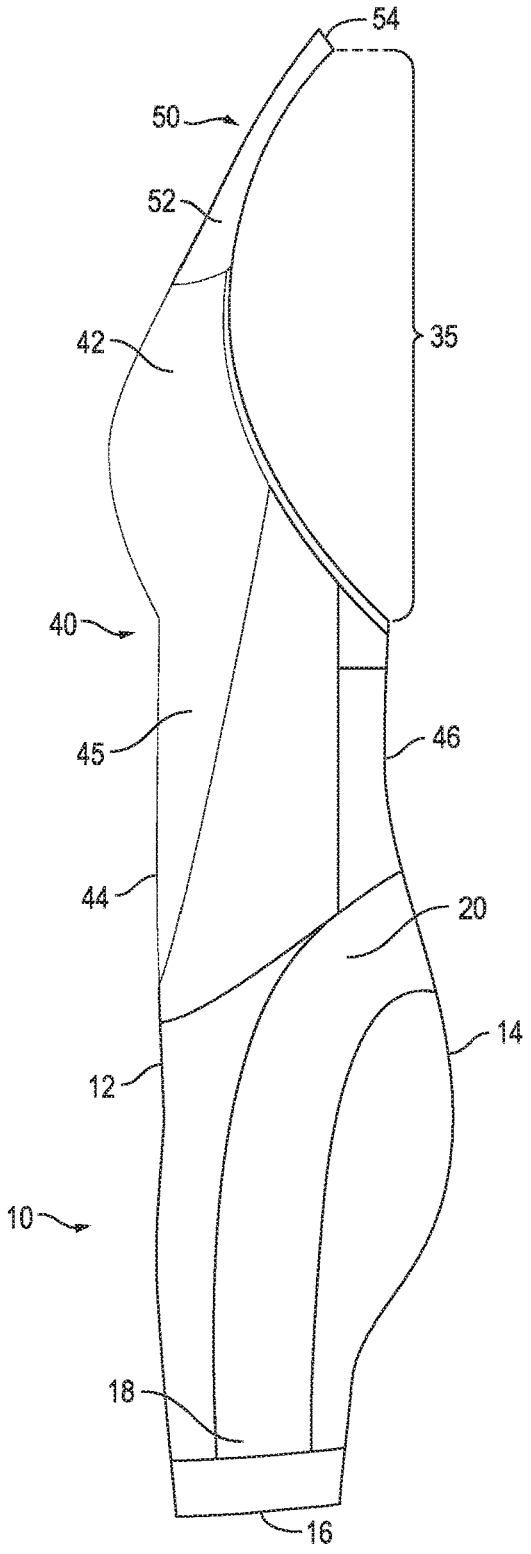
FIG. 5 is a side view of a halter bib athletic garment.

Similarly, an upper body section 40 may comprise a back opening 35 shown in FIG. 4) and a halter strap 50 forming at least a portion of a loop around a head opening 55 on the upper body section 40. In such an embodiments, the back opening 35 may extend from the rear side portion 54 of the halter strap 50 to at least one-third of a distance between the rear side portion 54 of the halter strap 50 and the rear side 14 of the pelvic section 20 of the lower body section 10. The back opening 35 may be devoid of any material extending across the back opening 35. In some embodiments, an upper body section 50 comprises only two body openings: a head opening 55 sized to receive a head 2 of a wearer and fit around the neck 4 of a wearer, and a back opening 35 sized to receive a torso 6 of the wearer. It is contemplated that other minor or small openings may exist in the upper body portion 40 of the athletic garment, but these other minor or small openings are not sized or otherwise configured to receive the head and/or torso of the wearer.

Figure 2A:
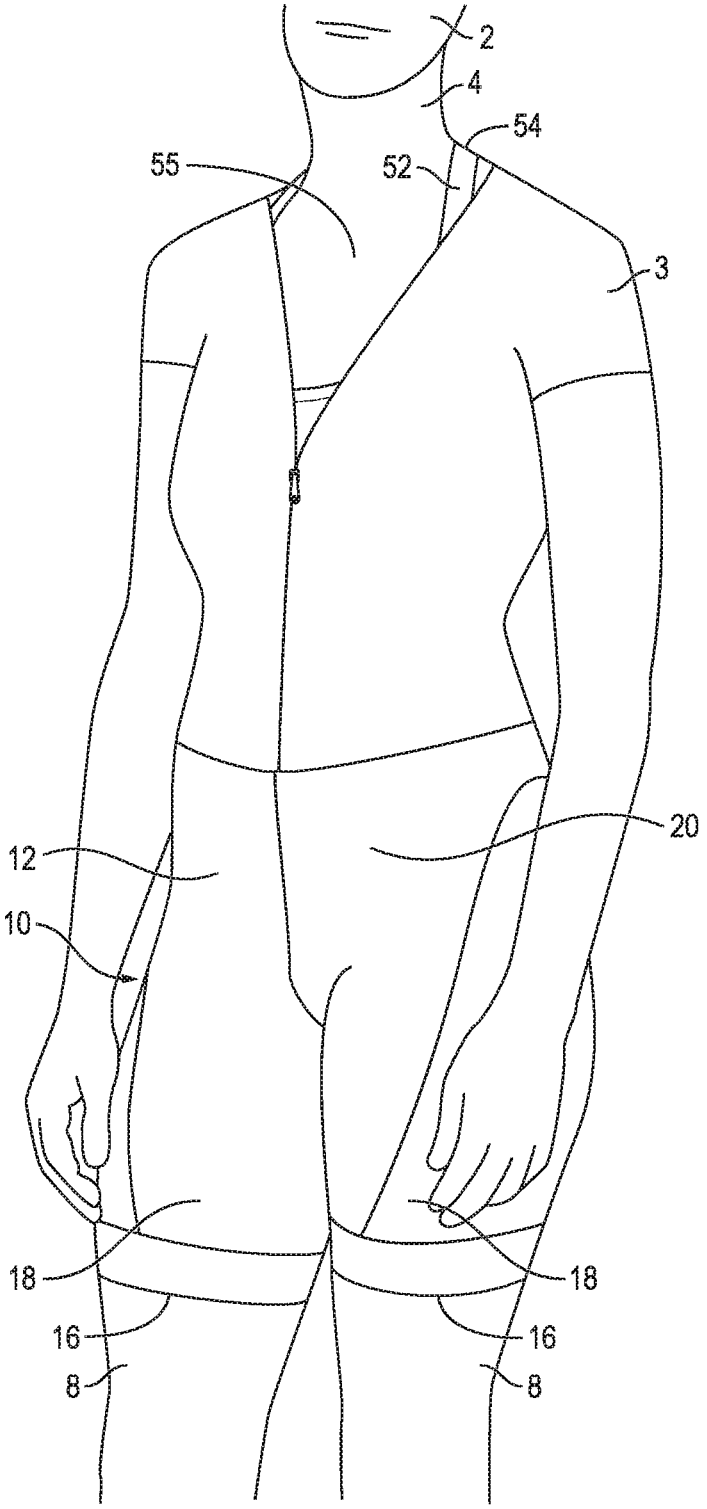
FIG. 2A is a perspective view of a halter bib athletic garment being worn by a wearer underneath a jersey.
Figure 2B:
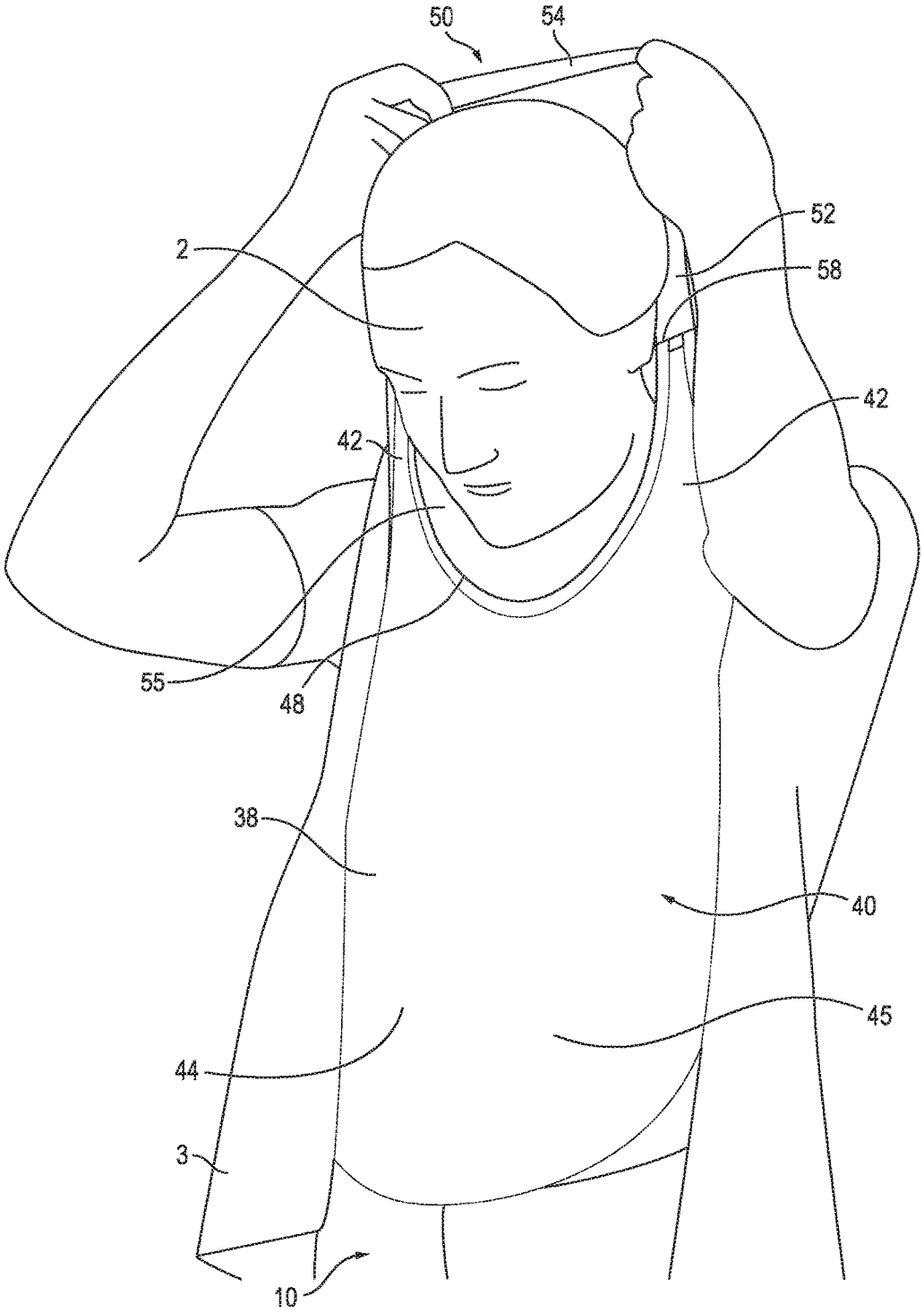
FIG. 2B is a perspective view of a halter strap of a halter bib athletic garment being pulled over the wearer's head while wearing the jersey in order to lower the halter bib athletic garment.

In each of these non-limiting configurations, the halter strap 50 is not directly coupled to any back portion of the athletic garment, thus allowing a wearer to conveniently pull the halter strap over his/her head to lower the upper body section 40 of the athletic garment 1, as shown in the non-limiting embodiment depicted in FIG. 2B. To put on the halter bib athletic garment 1, a wearer inserts both legs 8 into the leg openings 16 on the lower body section 10 and brings the loop 48 formed at least partially by the halter strap 50 over the wearer's head until the halter strap 50 rests on the wearer's neck 4 and shoulders. In various embodiments, the halter strap 50 may be constructed of an elastomeric fabric that has more stretch than the primary fabric(s) of the halter bib athletic garment 1, which allows the halter strap 50 to comfortably fit over the wearer's head 2, but also provide tension sufficient to hold up the halter bib athletic garment 1. Alternatively, the halter strap 50 may be constructed of the same or similar elastomeric fabric as the primary fabric(s) of the halter bib.

Figure 6:
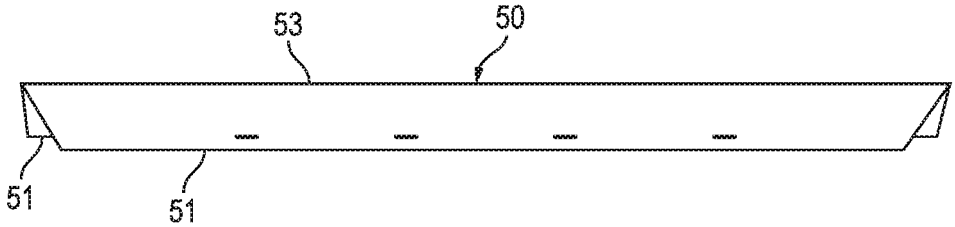
FIG. 6 is a side view of a folded halter strap.
Figure 7:
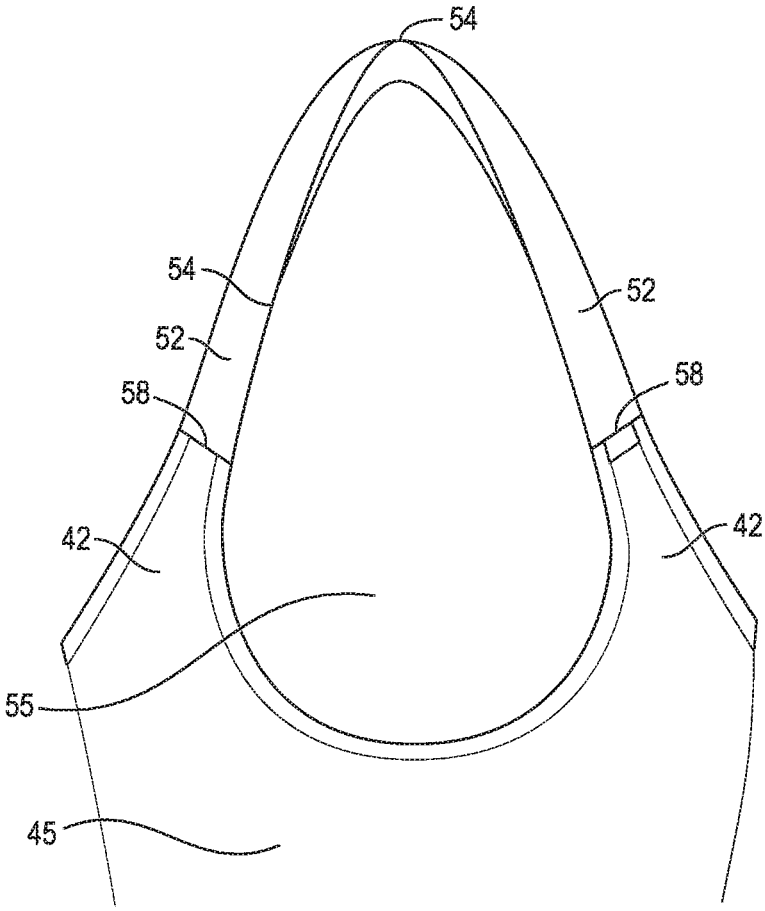
FIG. 7 is a front view of a halter strap coupled to a bodice section of a halter bib athletic garment.

Various embodiments of a halter strap 50 contemplated in this disclosure may comprise a folded halter strap 50. For example, a halter strap 50 may comprise a strip of material folded at least partially over on itself to form a folded edge 53 and a side edge 51. FIG. 6 depicts a non-limiting embodiment of a folded halter strap 50 before coupling of the two side edges 51 to one another. The two side edges 51 may be coupled approximately adjacent one another to form a single border opposite the folded edge 53. According to some aspects, the folded edge 53 of the halter straps 50 forms at least a portion of the loop 48 of the head opening 55, thus improving the comfort of the athletic garment 1.

One or more embodiments of an athletic garment 1 may comprise an upper body section 40 comprising a bodice section 45 and halter strap 50. FIGS. 1-5 depict various views of non-limiting embodiment of an athletic garment 1 comprising a bodice section 45 and a halter strap 50 on an upper body section of the athletic garment 1. The bodice section 45 may be positioned between the halter strap 50 and the pelvic section 20 of the lower body section 10. In some embodiments, such as the non-limiting embodiment shown in FIGS. 1-3, a bodice section 45 comprises a front side 44 that extends from a front side 12 of the lower body section 10 two the head opening 55. In more particular embodiments, a bodice section 45 may comprise two peaks 42 on a front side 44 of the bodice section 45, each peak 42 being coupled to a different terminating end 58 of the halter strap 50 such that the width of the halter strap 50 at each end 58 is greater than the width of the mesh portion at each of the adjoining portions of the two peaks 42. In other embodiments, the halter strap 50 comprises continuous material with the front side 44 of the bodice section 44.

FIG. 4 depicts a rear side 46 of a non-limiting embodiment of a bodice section 45. Although a bodice section 45 is shown extending approximately ⅓ of a distance from the lower body section 10 to the rear side portion 54 of the halter strap 50 in FIG. 4, it is contemplated that the rear side 46 of the bodice section 45 of other embodiments may comprise varying dimensions. For example, in some embodiments, the rear side 46 of the bodice section 45 may extend approximately ⅔ of a distance from the lower body section 10 to the rear side portion 54 of the halter strap 50, or just under the armpits of the user. In other embodiments, the rear side 46 of the bodice section 45 may extend any distance from the lower body section 10 to the rear side portion 54 of the halter strap 50 so long as the back opening 35 is devoid of any material connecting the halter strap 50 to the rear side 46 of the bodice section 45 and prevent the wearer from pulling the halter strap 50 over his/her head and pulling the upper body section 40 down from the upper body of the wearer. In still other embodiments, the bodice section 45 is less than ⅓ of a distance from the lower section 10 to the rear side portion 54 of the halter strap 50, or even devoid of a rear side 46 of a bodice section 45. In each of these embodiments, the back opening 35 is sized in complementary to the rear side 46 of the bodice section 45. For example, a back opening 35 may comprise approximately ⅓ of a distance between the lower body section 10 and the rear side portion 54 of the halter strap 50 and the rear side 44 of the bodice section may comprise approximately ⅔ of a distance between the lower body section 10 and the rear side portion 54 of the halter strap 50. Alternatively, a back opening 35 may comprise approximately ⅔ of a distance between the lower body section 10 and the rear side portion 54 of the halter strap 50 and the rear side 44 of the bodice section may comprise approximately ⅓ of a distance between the lower body section 10 and the rear side portion 54 of the halter strap 50.

Figure 8A:
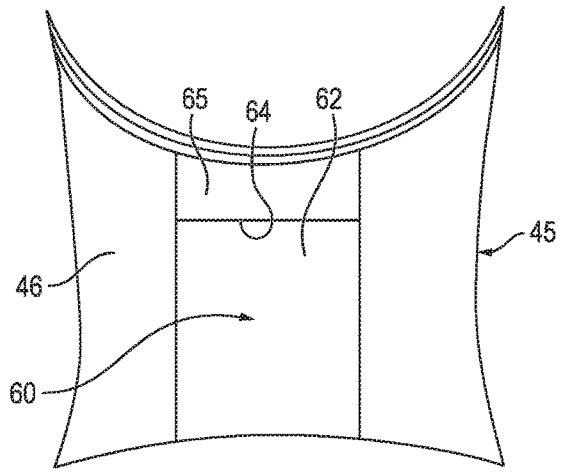
FIG. 8A is an outside view of a rear side of a bodice section of a halter bib athletic garment.
Figure 8B:
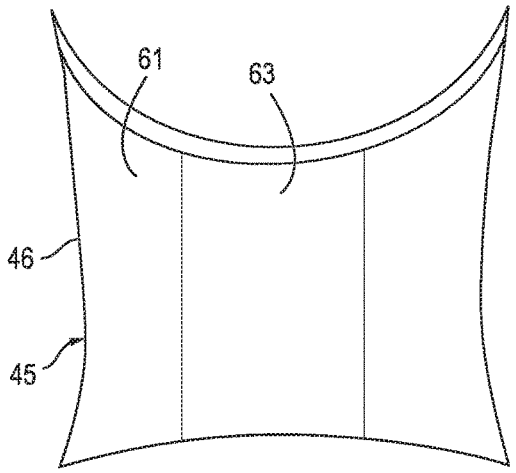
FIG. 8B is an inside view of a rear side of a bodice section.
Figure 8C:
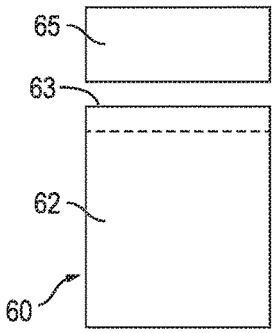
FIGS. 8C-E are views of the pocket of an athletic garment.
Figure 8D:
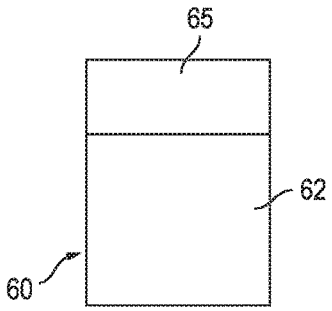
Figure 8E:
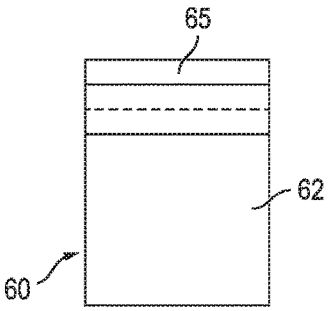
Figure 9A:
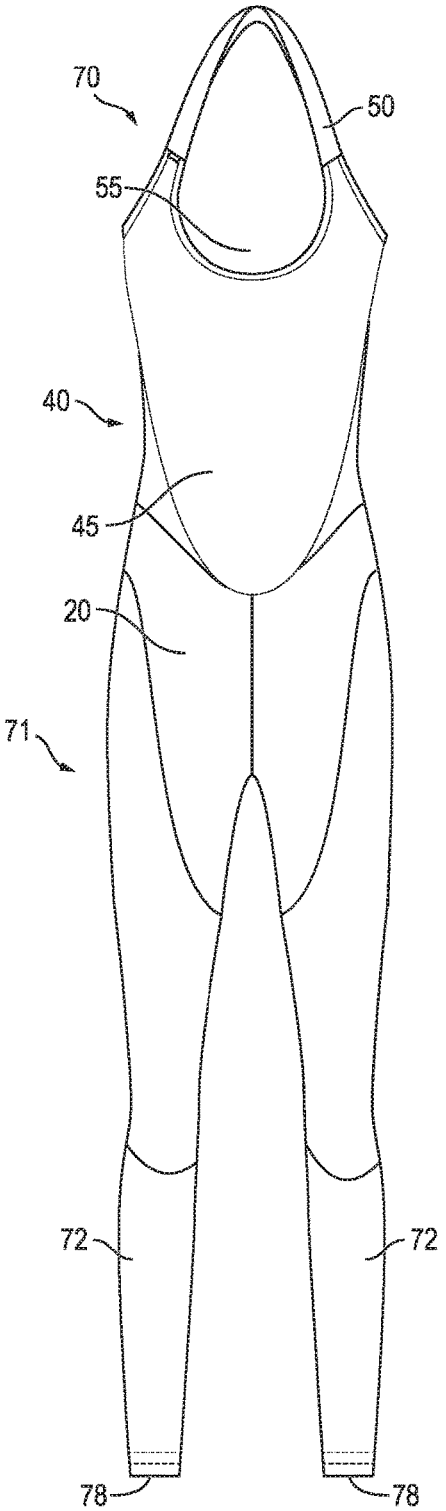
FIG. 9A is a front view of a halter bib athletic garment having full-length legs.
Figure 9B:
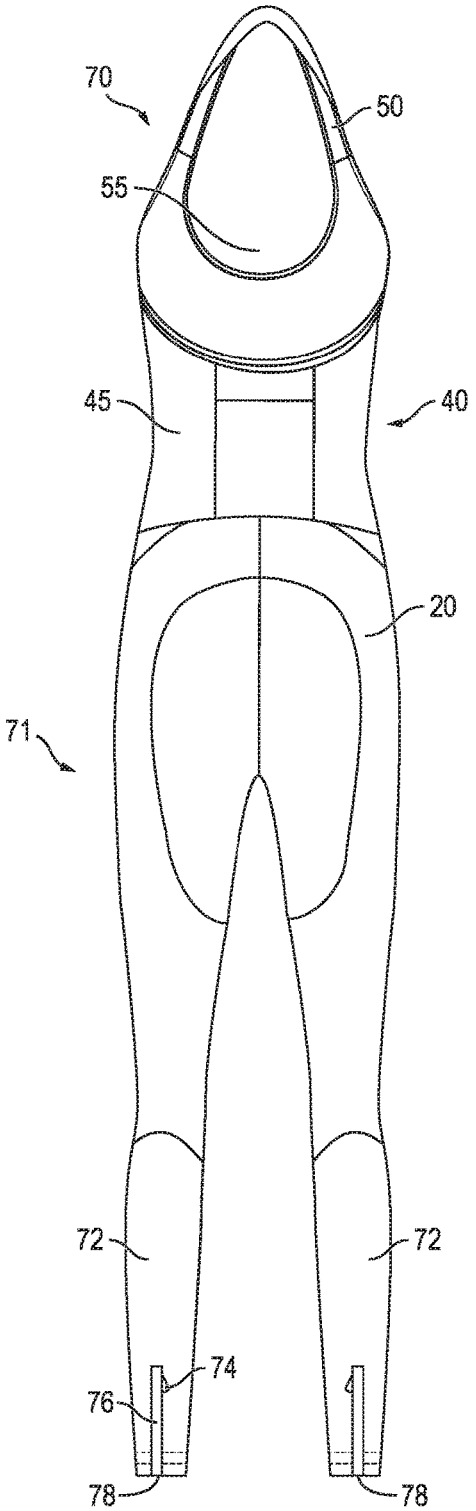
FIG. 9B is a rear view of a halter bib athletic garment having full-length legs.
Figure 9C:
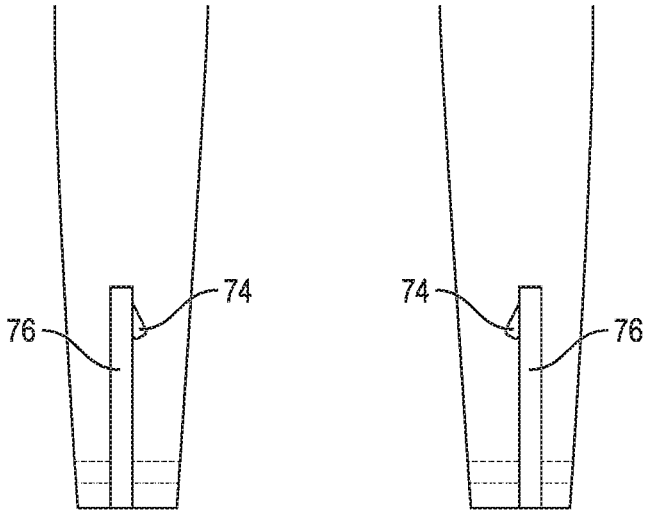
FIG. 9C is a rear view of the lower portion of the full-length legs of the halter bib athletic garment shown in FIGS. 9A and 9B.

Various embodiments of an athletic garment 1 contemplated in this disclosure may further comprise a pocket 60 formed on the bodice section 45 of the upper body section 40 of the athletic garment 1. For example, the non-limiting embodiment shown in FIG. 4 comprises a pocket 60 formed on the rear side 46 of the bodice section 45. In other embodiments, a pocket 60 may be formed on the front side 44 of the bodice section 45. FIG. 8A-E depicts various views of a non-limiting embodiment of a pocket 60 according to this disclosure. The pocket 60 may comprise a pocket opening 64 in an outer layer of the bodice section 45, such as the rear side 46 of the bodice section 45. Pockets 60 can be added to other areas on the exterior or interior of the athletic garment 1. A flap 65 on the outer surface 62 of the outer layer may overlap the pocket opening 64. In some embodiments, the flap 65 comprises only one edge, such as the bottom edge, that is not coupled to the outer surface 62 of the outer layer, thus allowing a user to access the pocket opening 64. By way of non-limiting example, the flap 65 may comprise a height of approximately 1¼" and may overlap the pocket opening 64 by approximate ¾" (as shown in FIG. 8E). In other embodiments, a pocket 60 may be secured with a clasp, zipper and so forth, or just by the tension from surrounding elastomeric fabric.

A pocket 60 may further comprise a single layer, such as but not limited to a mesh material 63, coupled to the inner surface 61 of the bodice section 45 around the pocket opening 64. This single inner layer forms the interior of the pocket 60. In some embodiment, the pocket 60 is large enough to hold a wallet, cellular phone, energy bar, keys, or other small items.

The bodice section 45 may be at least partially constructed of a mesh fabric 38 or similar fabric that provides good ventilation, for example, as shown by the mesh bodice section in FIGS. 1-5. A jersey or other top is typically worn over part or the entire mesh bodice section 45 (e.g., to cover a substantially transparent mesh bodice section). One or more additional layers of fabric may be added behind all or part of the mesh bodice section to reduce transparency in particular embodiments. Other embodiments may not use mesh or may have mesh included in different or smaller sections of the bodice section. In some, non-limiting embodiments, the front side 44 of the bodice section 45 is primarily mesh fabric 38 and the rear side 46 of the bodice section 45 is primarily material similar to the lower body section 10 of the athletic garment 1.

In other embodiments, an athletic garment 1 may be devoid of a bodice section 45 shown in FIGS. 1-5, and instead a halter strap 50 may extend from the lower body section 10, around the neck 4 of the wearer (when worn), before returning to either the lower body section 10 or another portion of the halter strap 50 such that only to body openings are formed: the head opening 55 and the back opening 35.

Figure 3:
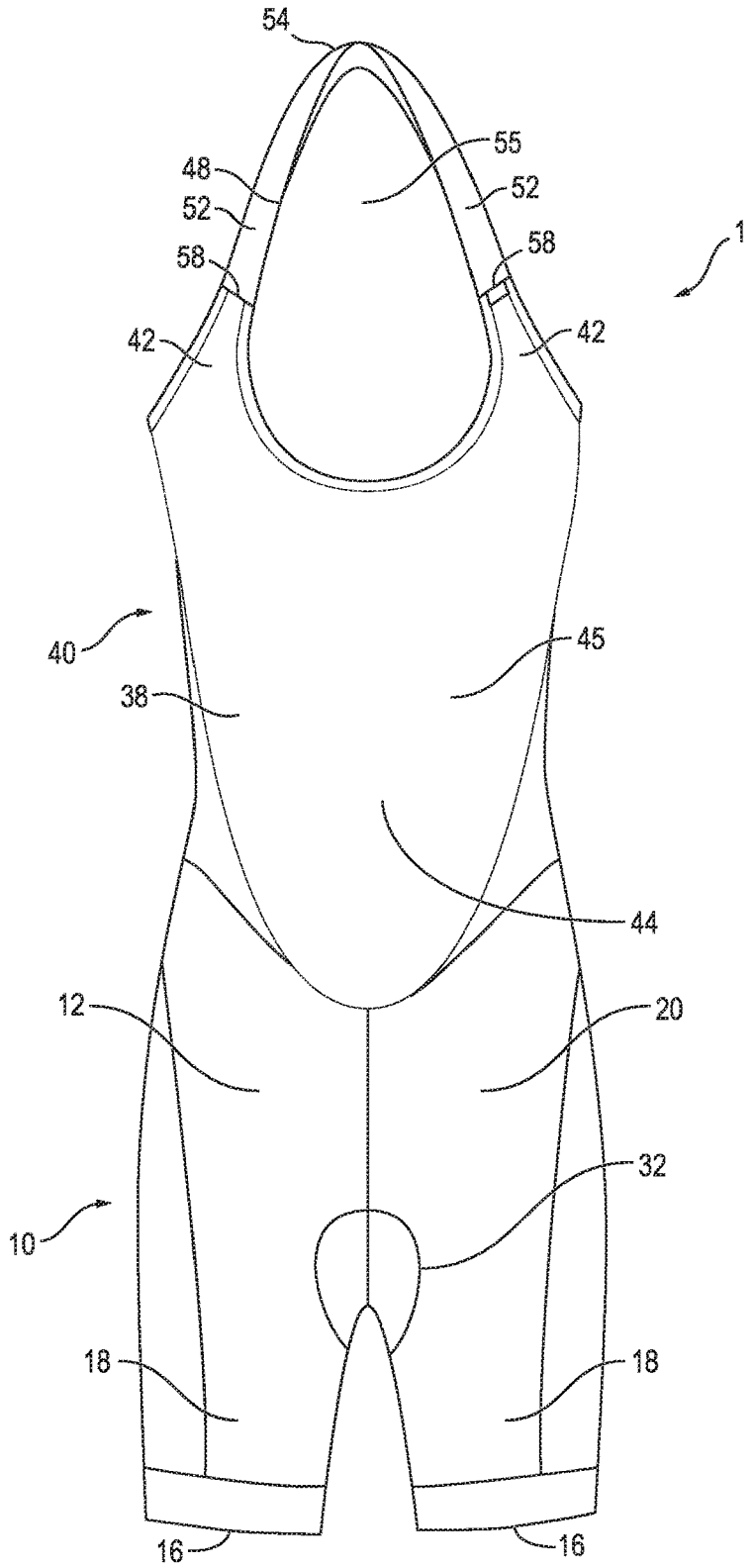
FIG. 3 is a front view of a halter bib athletic garment.
Figure 10:
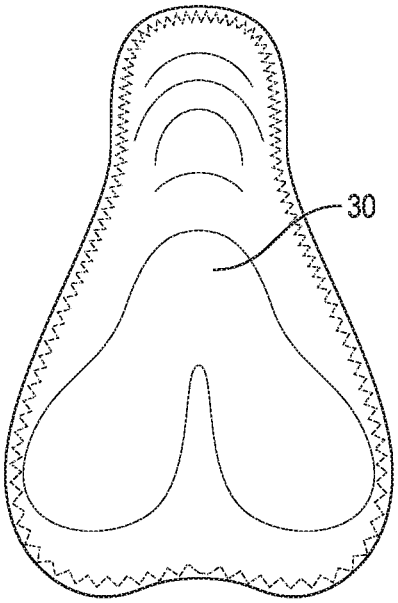
FIG. 10 is a top view of a chamois.

One or more embodiments of an athletic garment 1 comprise a lower body section 10. The lower body section comprises a pelvic section 20 and two legs 18 each having a leg opening 16 distal the upper body section 40. The legs 18, the pelvic section 20, and/or at least portions of the bodice may all be constructed using a single type of fabric, or several fabric types may be used. Fabrics used in the halter bib athletic garment 1 may be selected for their ability to wick away moisture and sweat of the wearer. In an embodiment using a short-style-length halter bib athletic garment 1, most or all of the leg sections are omitted. In some embodiments including, for example, cycling sports, a chamois 30 is included at the base of the pelvic section 20 where the leg sections 18 meet. FIG. 10 depicts a non-limiting embodiment of a chamois 30, and FIG. 3 shows an outline of the stitching 32 sometimes visible on the exterior of the lower body section 10 and coupling the chamois 30 to the base of the pelvic section 20. The chamois 30 is a soft and spongy layer designed to provide padding while seated (e.g., a bicycle saddle) and to wick away moisture and sweat. The chamois 30 generally conforms to the crotch of the wearer and may vary in thickness (e.g., about 0.125 to 3.5 inches thick) and shape (e.g., different shapes for males, females, intended type of use, or intended length of use). The chamois 30 may be constructed from CoolMax® from Invista® or a similar material.

In some embodiments, a halter bib athletic garment 1 is primarily worn for cycling sports. Traditional cycling bibs are popular choices over cycling shorts because they avoid the discomfort and chafing of a waistband and tend to properly retain the position of the chamois under a cyclists' sit bones. Traditional cycling bibs utilize two suspender-style support members, which causes the wearer to remove both support members (over each shoulder and arm) to remove or lower the traditional cycling bib. In contrast, the disclosed halter bib athletic garment embodiments may be removed or lowered by passing the halter strap 50 over the wearer's head 2 and lowering the upper body section 40 without the requirement to remove anything from the wearer's arms. In cycling, a wearer often wears the halter bib athletic garment 1 underneath a jersey, shirt, jacket or other covering, such as the jersey 3 shown in FIGS. 2A and 2B.

Jerseys come in many varieties having different fabrics, cuts, sleeve lengths, and front zipper styles. One type of cycling jersey may be commonly called a "jacket" where the jersey is intended for colder weather. Of particular note, many jerseys have a front zipper extending from the wearer's neck downward, such as the jersey 3 shown in FIGS. 2A and 2B. The front zipper extends downward to various lengths, ranging from a few inches to the full length of the jersey. For example, many jerseys have a half-length zipper that extends to about the base of the wearer's sternum. With a traditional cycling bib, the wearer must remove the jersey to then remove the two support members over the wearer's arms in order to finally lower or remove the traditional cycling bib. However, a halter bib athletic garment of this disclosure can be removed or lowered without removing the jersey, as shown in FIG. 2B. With a full-length zipper jersey, the wearer unzips the jersey partially or fully, passes the halter strap 50 over their head 2, and then removes or lowers the upper body section 40 of the halter bib athletic garment 1. With a half-length zipper jersey (or any jersey with a zipper shorter than full-length), the wearer unzips the jersey, passes the halter strap 50 over the wearer's head 2, optionally pulls the halter strap 50 and bodice 45 through the lower portion of the jersey, and then removes or lowers the halter bib athletic garment 1. Thus, the halter bib athletic garment 1 may be lowered or removed without removing the jersey.

Embodiments of a halter bib athletic garment allow wearers to more readily urinate or have a bowel movement because the halter bib athletic garment 1 may be easily lowered or removed. For example, a cyclist wearing a halter bib athletic garment 1 can quickly stop cycling and urinate without the hassle and exposure of removing a jersey. Female cyclists benefit greatly from the halter bib athletic garment 1 because their anatomy provides fewer options for quickly and easily urinating or passing a bowel movement than the options enjoyed by male cyclists (some male cycling bibs and shorts have a zippered or non-zippered fly). For example, a female cyclist wearing a halter bib athletic garment can lower the halter bib athletic garment 1 to urinate such that the chamois 30 is out of the way and not contaminated by streaming or stray urine.

According to some embodiments, the halter strap 50 is constructed of a continuous elastomeric fabric. The halter strap 50 and connected bodice section 45 may be sufficiently elastomeric to allow the halter strap 50 to easily pass over the wearer's head 2. The vertical elasticity of the halter strap 50 may result from elasticity primarily within the halter strap 50, or the elasticity of the halter strap 50 and bodice section 45 combined. For example, the halter strap 50 may be a fabric with high elasticity along the long axis of the halter strap 50 that allows the halter strap 50 to stretch under pressure, but resume a shorter length when resting on the wearer's neck 4 and shoulders. The optional mesh bodice section 45 may employ an elastomeric mesh fabric having a high degree of vertical elasticity throughout at least part of the fabric. Additionally, the mesh bodice section 45 may extend above the breasts to couple to the halter strap 50, which may provide additional vertical elasticity by allowing the halter strap 50 to pull on the elastomeric mesh fabric of the bodice section 45 by transferring the force substantially to the mesh bodice section 45. Additional embodiments employ a non-mesh elastomeric fabric in place of the optional mesh bodice section 45 to similarly provide ventilation and elastomeric stretching.

In some particular embodiments, the halter strap 50 employs one or more connecting members or cinching members. Connecting members may be clasps, latches, buckles, joints, interconnectors, loops, snaps, and so on. Cinching members may be cinches, fasteners, cams, ratchets, rings, slides, adjusters, locks, or similar mechanisms. One embodiment employs a connecting member at or near the halter strap to allow the wearer to disconnect or unclasp the connecting member and pass the head through the disconnected halter strap. Another embodiment employs at least two connecting members to completely remove the halter strap from the bodice section. Further embodiments employ one or more cinching members at or near the halter strap to expand the halter strap and then cinch the halter strap over the wearer's neck and shoulders to a comfortable fit. Yet further embodiments employ one or more cinching members used in conjunction with the elasticity provided by the elastomeric fabric and other elastomeric features of the halter bib disclosed herein.

Embodiments of a halter bib athletic garments 1 may include reflectors made from reflective fabrics or other reflective materials. The reflectors assist in making a wearer visible in low-light conditions by, for example, reflecting the light from vehicle headlights. The reflectors may be stripes, piping, patches, or other shapes sewn into or otherwise affixed to the halter bib. Some embodiments employ reflectors as part of the aesthetic design of the halter bib athletic garment to add to the design even during daylight.

Further embodiments of the halter bib athletic garment 70 comprise full-length legs 72 (shown in FIGS. 9A and 9B) include leg-positioning features, such as leg bands and access zippers 74. One embodiment includes one or more leg bands on the interior circumference of each leg section. The leg band may be an exposed elastic or gel near the hem of a short-length halter bib athletic garment to grip the wearer's thighs and limit the leg sections from creeping up the thighs as is known in the art. The leg band approximately encircles the circumference of the leg and may be approximately 0.25 to 2.5 inches wide. Alternative embodiments utilize two or more leg bands in each leg section, where the leg bands are spaced apart. Further embodiments employ access zippers 74 approximately 2 to 10 inches long near the leg openings 78 proximate ankles or calves of the wear on a full-length or capri-length halter bib athletic garment 70 to allow wearers to insert their feet through openings 78 enlarged by opening the access zippers 74. Zipper covers 76 may be positioned proximate the zippers 74 to cover the zippers 74 during use (shown in FIG. 9C).

It will be understood that embodiments are not limited to the specific components disclosed herein, as virtually any components consistent with the intended operation of the various embodiments may be utilized. Accordingly, for example, it should be understood that, while the drawing figures accompanying text show and describe particular embodiments and embodiments, components may comprise any shape, size, style, type, model, version, class, grade, measurement, concentration, material, weight, quantity, and/or the like consistent with the intended operation of a methods and/or system embodiments.

The concepts disclosed herein are not limited to the specific embodiments shown herein. For example, it is specifically contemplated that the components included in particular embodiments may be formed of any of many different types of materials or combinations that can readily be formed into shaped objects and that are consistent with the intended operation of the embodiments. For example, the components may be formed of: rubbers (synthetic and/or natural) and/or other like materials; fibers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, embodiments may be manufactured separately and then assembled together, or any or all of the components may be manufactured simultaneously and integrally joined with one another. If any of the components are manufactured separately, they may then be coupled or removably coupled with one another in any manner, such as with adhesive, heat welds, fasteners, sewn stitches, any combination thereof, and/or the like for example, depending on, among other considerations, the particular material(s) forming the components.

The invention claimed is:

1. A cycling bib, comprising:

a lower body section comprising two leg portions each terminating in a respective leg opening, a pelvic section between the two leg portions, the pelvic section comprising a chamois coupled at a base thereof, the two leg portions joining into a tubular waist portion extending from upper ends of the two leg portions, the tubular waist portion comprising a front side and a rear side;

a bodice coupled to an upper end of the tubular waist portion of the lower body section, the bodice comprising a mesh material, a front side of the bodice terminating in respective left and right peaks on respective left and right sides of the front side of the bodice, the bodice further comprising at least a portion of a loop extending across the front side of the bodice and configured to be positioned above breasts of a wearer, the at least a portion of the loop extending from the left peak to the right peak across the front side of the bodice; and a continuous, uninterrupted comprising an elastic material, the halter strap elastic material of the halter strap being different from the mesh of the bodice material and folded between a first edge and a second edge so that the elastic material forms the halter strap having a length greater than its width with the elastic material of the halter strap along the first edge and the second edge overlapping itself only a single time, the halter strap comprising a first end and a second end, each of the first end and the second end fixedly sewn to a different one of the respective left and right peaks and not directly coupled to a rear side of the bodice wherein the width of the halter strap at each of the first and second ends is greater than a width of a mesh portion of the mesh material of the bodice at each of the respective left and right peaks.

2. The cycling bib of claim 1, the cycling bib comprising the rear side of the bodice comprising a mesh panel centered on the rear side of the bodice adjacent a top edge of the rear side of the bodice, the rear side of the bodice further comprising a pocket on an outer surface of the rear side of the bodice overlaying the mesh panel, the pocket comprising a pocket outer layer affixed to the outer surface of the rear side of the bodice about the mesh panel, a flap affixed to the outer surface of the rear side of the bodice above the pocket outer layer and configured to cover a pocket opening.

3. The cycling bib of claim 1, wherein the two leg portions are each full leg portions configured to extend to proximate the wearer's ankles or calves.

4. The cycling bib of claim 1, wherein each of the two leg openings comprises an elastic band or gel band on an inside surface of each of the two leg openings.

5. The cycling bib of claim 1, wherein the front side of the bodice section is formed primarily of the mesh material.

6. The cycling bib of claim 1, wherein the bodice is configured to cover a majority of a chest of the wearer of the cycling bib.

7. A cycling bib, comprising:

a lower body section comprising two leg portions each terminating in a respective leg opening, a pelvic section between the two leg portions, the pelvic section comprising a chamois coupled at a base thereof, the two leg portions joining into a tubular waist portion extending from upper ends of the two leg portions, the tubular waist portion comprising a front side and a rear side;

a bodice coupled to an upper end of the tubular waist portion of the lower body section and extending upward of the tubular waist portion, a front side of the bodice terminating in respective left and right peaks on respective left and right sides of the front side of the bodice, the bodice further comprising at least a portion of a loop extending across the front side of the bodice and configured to be positioned above breasts of a wearer, the at least a portion of the loop extending from the left peak to the right peak across the front side of the bodice; and a continuous, uninterrupted halter strap consisting essentially of an elastic material and comprising a first end and a second end, each of the first end and the second end fixedly sewn to a different one of the respective left and right peaks and not directly coupled to the rear side of the bodice, wherein a width of the halter strap at each of the first and second ends is greater than a width of a mesh portion of mesh material of the bodice at each of the respective left and right peaks.

8. The cycling bib of claim 7, wherein the continuous, uninterrupted halter strap is folded a single time between a first edge and a second edge.

9. The cycling bib of claim 7, wherein the elastic material of the halter strap overlaps itself only a single time.

10. The cycling bib of claim 7, wherein the front side of the bodice is formed primarily of the mesh material and the elastic material of the halter strap is different from the mesh material of the bodice.

11. The cycling bib of claim 7, further comprising a pocket on an outer surface of the rear side of the bodice, the pocket comprising a pocket outer layer affixed to the outer surface of the rear side of the bodice, a flap affixed to the outer surface of the rear side of the bodice above the pocket outer layer and configured to cover a pocket opening.

12. The cycling bib of claim 11, wherein the rear side of the bodice further comprises a mesh layer on the rear side of the bodice beneath the pocket outer layer, the pocket outer layer affixed to the outer surface of the rear side of the bodice about an edge of the mesh layer.

13. The cycling bib of claim 7, wherein the two leg portions are each full leg portions configured to extend to proximate the wearer's ankles or calves.

14. The cycling halter bib of claim 7, wherein each of the two leg openings comprises an elastic band or gel band on an inside surface of each of the two leg openings.

15. The cycling bib of claim 7, wherein the front side of the bodice is formed primarily of the mesh material.

16. The cycling bib of claim 7, wherein the bodice is configured to cover a majority of a chest of the wearer of the cycling bib.

* * * * *